US005801494A

United States Patent [19]

Herres et al.

[11] Patent Number: 5,801,494

[45] Date of Patent: Sep. 1, 1998

[54] RAPID RESTRIKE WITH INTEGRAL CUTOUT TIMER

[75] Inventors: Donald C. Herres, Fayetteville; John Harry Gold, Binghamton, both of N.Y.

[73] Assignee: Cooper Industries, Inc., Houston, Tex.

[21] Appl. No.: 651,906

[22] Filed: May 21, 1996

[51] Int. Cl.[6] ..... H05B 37/00

[52] U.S. Cl. ..... 315/289; 315/360; 315/119; 315/290

[58] Field of Search ..... 315/105, 119, 315/276, 289, 209 R, 360, DIG. 2, 290, DIG. 5

[56] References Cited

U.S. PATENT DOCUMENTS

| | | | |
|---|---|---|---|
| 4,480,214 | 10/1984 | Sodini | 315/290 |
| 4,494,012 | 1/1985 | Coker | 315/360 X |
| 4,591,781 | 5/1986 | Larson | 315/360 X |
| 4,745,341 | 5/1988 | Herres | 315/176 |
| 4,881,012 | 11/1989 | Almering | 315/209 R |
| 4,896,077 | 1/1990 | Dodd et al. | 315/289 |
| 4,949,018 | 8/1990 | Siglock | 315/225 |
| 4,962,336 | 10/1990 | Dodd et al. | 315/290 |
| 4,996,464 | 2/1991 | Dodd et al. | 315/289 |
| 5,055,742 | 10/1991 | Jurell et al. | 315/94 |
| 5,070,279 | 12/1991 | Garbowicz et al. | 315/289 |
| 5,103,137 | 4/1992 | Blake et al. | 315/119 |
| 5,428,268 | 6/1995 | Melis et al. | 315/247 |
| 5,616,990 | 4/1997 | Garbowicz et al. | 315/103 |

OTHER PUBLICATIONS

Sales Brochure for "Advance Hot Restrike Ignitor for Enhanced Performance of Low Wattage High Pressure Sodium Systems", Product Profile, Advance Transformer Co., Mar. 1997.

*Primary Examiner*—Robert J. Pascal
*Assistant Examiner*—Haissa Philogene
*Attorney, Agent, or Firm*—Burns, Doane, Swecker & Mathis, L.L.P.

[57] ABSTRACT

A single, integrated circuit combining both a restrike ignitor and a digital timer cutout which generates high voltage pulses for starting and restarting high intensity discharge lamps, including high pressure sodium lamps, without generating an excessive amount of heat.

16 Claims, 3 Drawing Sheets

RAPID RESTRIKE WITH INTEGRAL CUTOUT TIMER

BACKGROUND

The invention relates to high intensity discharge (HID) lamps. More specifically, the invention relates to restarting high pressure sodium (HPS) lamps, which are a specific type of HID lamp, using a single, integrated circuit design that combines an improved restrike circuit with a cutout timer.

HID lamps are typically used for illuminating large open spaces such as roads (i.e., street lamps) and construction sights. These lamps contain one or more gases. In order to illuminate the lamp, the gas inside the lamp must be ionized to conduct electricity. HPS lamps contain both sodium and xenon gas. Xenon gas is used in conjunction with sodium because xenon is easier to ionize than sodium when the lamp is cool (i.e., the operational temperature of the lamp is low). As the xenon gas ionizes, the relative concentration of xenon gas begins to decrease (i.e., the xenon gas pressure decreases) while the operating temperature of the lamp and the relative concentration of sodium vapor begins to increase. Consequently, as the concentration of sodium vapor increases, it becomes easier to ionize the sodium and thus illuminate the lamp. However, to initiate the ionization process, starting aids, such as standard ignitors and restrike ignitors, are required. Both standard ignitors and restrike ignitors initiate ionization by generating a series of high frequency, high voltage pulses across the base of the lamp.

In general, restrike ignitors and standard ignitors are well known to those skilled in the art. For example, U.S. Pat. No. 4,745,341 issued to Herres in May 1988 describes a rapid restrike starter for high intensity discharge lamps; U.S. Pat. No. 4,527,098 issued to Owen in July 1985 describes a discrete starter for HID lamps; and U.S. Reissued Pat. No. 31,486 issued to Helmuth in January 1984 describes rapid starting of gas discharge lamps.

Restrike ignitors and standard ignitors operate in a similar manner. Both are capable of starting a cold HPS lamp. Both start a HPS lamp by delivering high voltage pulses (typically greater then 2,000 volts) across the base of the lamp. Both must generate the pulses at or near the peak of an input sine wave to generate sufficient energy to ionize the gas inside in the HPS lamp.

The major difference between standard ignitors and restrike ignitors is that restrike ignitors produce a pulse which contains far more energy than a pulse generated by a standard ignitor. This permits restrike ignitors to immediately restart hot lamps. Typically, the voltage of a pulse generated by a restrike ignitor is in the order of 7,000 volts. This energy, needed to generate the high voltage pulses, is stored in one or more capacitors, and the pulses are generated when the capacitors discharge through a transformer (as will be explained in greater detail herein below). In terms of ignition performance, restrike ignitors are capable of igniting HPS lamps much more rapidly than standard ignitors. Because the pulses generated by restrike ignitors contain so much energy, the restrike ignitors can restart a HPS lamp even though the concentration of xenon gas is relatively low compared to the relative concentration of sodium vapor. Because the pulses generated by standard ignitors do not contain as much energy, standard ignitors must wait for the HPS lamp to sufficiently cool and the relative concentration of xenon gas (i.e., the xenon gas pressure) to rise before they can ignite the lamp. Typically, standard ignitors may take 40 seconds or more to restart an HPS lamp.

In the past, both restrike ignitors and standard ignitors were designed to continuously deliver high voltage pulses to the base of the lamp until the lamp illuminated. This was problematic for several important reasons. First, continuous pulsing causes electrical components, such as ballasts, wires, and insulation, to wear out more quickly. Second, the voltage across the base of an illuminated lamp may, on occasion, exceed expected voltage levels. Interpreting this abnormal condition as a lamp that is not illuminating, restrike ignitors and standard ignitors in the past would have continued to provide pulses to the already illuminated lamp, resulting in a visible strobing of the lamp. Third, HPS lamps, go into a cycling phase for a period of time prior to final lamp failure. Continuous pulsing causes HPS lamps in the cycling phase to oscillate back and forth between an illuminated state and a non-illuminated state. Aside from being extremely annoying, this oscillation between an illuminated state and a non-illuminated state makes it very difficult for maintenance crews to identify HPS lamps in need of replacement.

To prevent the problems associated with continuous pulsing, manufacturers introduced cutout timers. For example, a cutout timer might generate a signal which shuts off the ignitor after a set period of time, so long as the set period of time is sufficient to allow the ignitor to restart the lamp. Also, cutout timers typically allow ignitors to begin delivering additional pulses only after the input voltage is refreshed (i.e., turned off and then turned back on), thereby preventing HPS lamps in the cycling phase from oscillating between an illuminated state and a non-illuminated state.

Cutout timers, like restrike ignitors and standard ignitors, are well known to those skilled in the art. For example, U.S. Pat. No. 5,070,279 issued to Garbowicz on Dec. 3, 1991, describes a lamp ignitor with an automatic shut-off feature; U.S. Pat. No. 4,962,336 issued to Dodd et al. on Oct. 9, 1990, describes an ignitor disabler for a HID lamp starter circuit with a disabling means that triggers after the passage of a predetermined amount of time; and U.S. Pat. No. 4,896,077 issued to Dodd et al. on Jan. 23, 1990, describes an ignitor disabler for a HID lamp starter circuit that includes a means to monitor lamp voltage and a disabling means that triggers when the lamp voltage exceeds a given threshold.

In addition to cutout timers, thermal cutout devices are also well known to those skilled in the art. Thermal cutouts are primarily used to protect the ignitor. Specifically, thermal cutouts prevent the continuous generation of pulses when the ambient temperature surrounding the ignitor circuit exceeds a predefined temperature threshold. The primary disadvantage of thermal cutouts is that they are never fully disabled. Once the lamp cools, thermal cutouts allow the ignitor to begin generating pulses. Therefore, thermal cutouts will not prevent a cycling HPS lamp from oscillating between an illuminated state and non-illuminated state as explained above.

Although restrike ignitors, standard ignitors and cutout devices, in general, are well known in the art as described above, there are no prior designs that incorporate both a restrike ignitor and a digital timing cutout device into a single, integrated design package. A single, integrated design package provides a number of advantages. First, an integrated design requires fewer electrical leads since external electrical connections linking the two devices would no longer be necessary. Second, integrated designs are more reliable; therefore, they are far less likely to fail under non-ideal conditions (e.g., variations in ballasts, lamps, input voltages, and input voltage waveforms). Third, integrated designs are much less expensive to manufacture.

One reason why there have been no prior designs combining both an ignitor and a cutout device into a single integrated package is the amount of heat these two devices typically generate. In general, this is due to the use of high watt resistors, which generate excessive amounts of heat, to help regulate the voltage level and timing of the high voltage ignitor pulses. If one were to attempt to integrate an ignitor with a cutout device using existing circuit designs, the amount of heat generated by such a device would likely result in an excessive number of lamp and lamp fixture failures for the reasons given above.

Furthermore, the excessive amount of heat generated by conventional restrike ignitor and cutout timer designs would actually preclude one from effectively combining them into a single integrated package. That is because the individual components used, especially the storage capacitors used in the ignitor circuitry, are highly sensitive to large ambient temperatures. As ambient temperatures approach the temperature rating of these components, the components are more likely to fail. By combining the ignitor circuitry and the cutout circuitry into a single, integrated package, the effects of temperature on the individual components becomes even more exaggerated since heat dissipation is more difficult. Therefore, any component in the ignitor and/or the cutout circuitry that produces an excessive amount of heat will exacerbate the problem.

To put the problem into perspective, the ambient temperature inside a HID lamp housing, due to the heat generated by the ballast and the HID lamp fixture alone, is approximately 90° C. This temperature does not reflect the additional heat that would be generated by a restrike ignitor and cutout timer circuit. If a conventional restrike ignitor and cutout timer were to be combined into a single integrated package, the excessive amount of heat that would be generated by such a device would cause the ambient temperature inside the HID lamp housing to rise significantly above 90° C. and approach or exceed the temperature rating for conventional restrike ignitor components, such as the metalized storage capacitors, which have a temperature rating of approximately 125° C. Therefore, combining a conventional restrike ignitor and cutout timer into a single integrated package would result in an unacceptable number of failures due to excessive heat generation.

Consequently, there is a real need to provide an ignitor, specifically a restrike ignitor, and a cutout device, specifically a cutout timer device, that generate less heat than prior designs, making it feasible to integrate both of these distinctly different devices into a single, integrated design package so as to realize the reliability, manufacturing, and performance advantages that such a design would provide, as discussed above.

SUMMARY

It is an object of the present invention to provide a rapid restrike circuit and a digital timer cutout circuit that prevents the continuous delivery of high voltage pulses to the base of a high intensity discharge (HID) lamp.

It is an object of the present invention to provide a rapid restrike circuit and a digital timer cutout circuit that prevents the continuous delivery of high voltage pulses to the base of a high pressure sodium lamp, a specific type of HID lamp, when the lamp is cycling or inoperative.

It is another object of the present invention to provide a rapid restrike circuit and a digital timer cutout circuit that is capable of immediately restarting a HPS lamp after a momentary loss of arc due to voltage fluctuations or power outages.

It is yet another object of the present invention to provide a single, integrated device incorporating both the rapid restrike circuit and the digital timer cutout circuit.

It is still another object of the present invention to provide a single, integrated device incorporating both the rapid restrike circuit and the digital timer cutout that dissipates less heat in order to minimize the time required to restart an HPS lamp.

It is another object of the present invention to provide a single, integrated device incorporating both the rapid restrike circuit and the digital timer cutout circuit that dissipates less heat by regulating the voltage level and timing of the high voltage restrike pulses with a novel circuit design in lieu of high watt resistors.

It is still another object of the present invention to provide a single, integrated device incorporating both the rapid restrike circuit and the digital timer cutout that dissipates less heat by limiting the number of high voltage pulses needed to restart the HPS lamp.

In accordance with one aspect of the present invention, the foregoing and other objects are achieved by an electronic circuit for illuminating a HID lamp comprising a restrike ignitor circuit that generates a plurality of restrike pulses for illuminating said HID lamp; and a digital timer cutout that prevents said restrike ignitor circuit from generating said plurality of restrike pulses after a time-out period elapses, wherein said restrike ignitor circuit and said digital timer cutout are combined into a single, integrated circuit.

In accordance with another aspect of the present invention, an electronic circuit for controlling the generation of a plurality of restrike pulses for a HID lamp comprising a restrike ignitor circuit that generates said plurality of restrike pulses; a digital timer cutout that prevents said restrike ignitor circuit from generating said plurality of restrike pulses after a time-out period elapses; and a pulse control circuit that controls said restrike ignitor circuit such that said restrike ignitor circuit generates said plurality of restrike pulses during at least one limited time interval in order to minimize heat generation, wherein said restrike ignitor circuit, said digital timer cutout, and said pulse control circuit are combined into a single, integrated circuit.

BRIEF DESCRIPTION OF THE DRAWINGS

The objects and advantages of the invention will be understood by reading the following detailed description in conjunction with the drawings in which.

DETAILED DESCRIPTION

Figure 1:
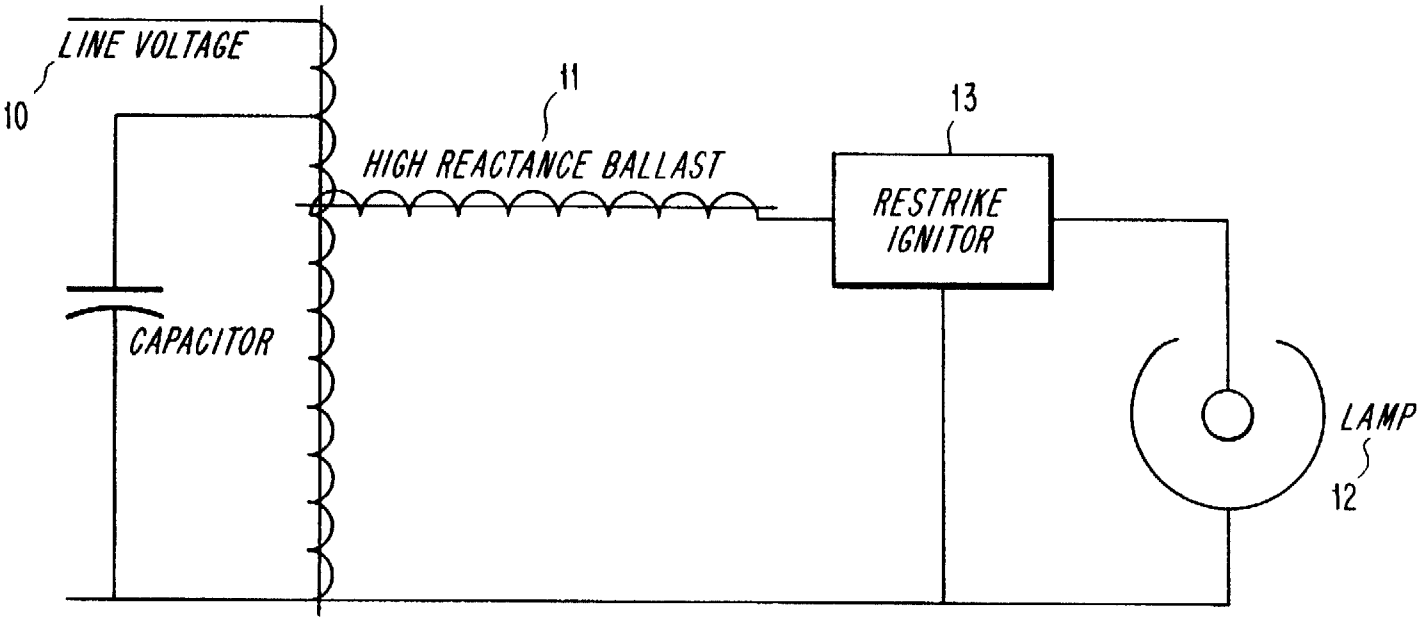
FIG. 1 shows the integrated rapid restrike and timer cutout device in relation to the HPS lamp, input power source, and ballast.

The present invention provides a combined rapid restrike and digital timer cutout in a single, integrated device having the ability to rapidly restart a high intensity discharge lamp (e.g., high pressure sodium lamp) following a voltage fluctuation or complete power loss by generating a series of high voltage, high frequency pulses to the base of the lamp without generating an excessive amount of heat. The present invention also provides the ability to prevent the restrike portion of the device from issuing the aforementioned pulses after a preset time period unless the input power is reset. FIG. 1 illustrates the physical relationship between the input power source 10, ballast 11, lamp 12, and the integrated rapid restrike and timer cutout circuit 13 (herein referred to as the "IRRTC").

Figure 2:
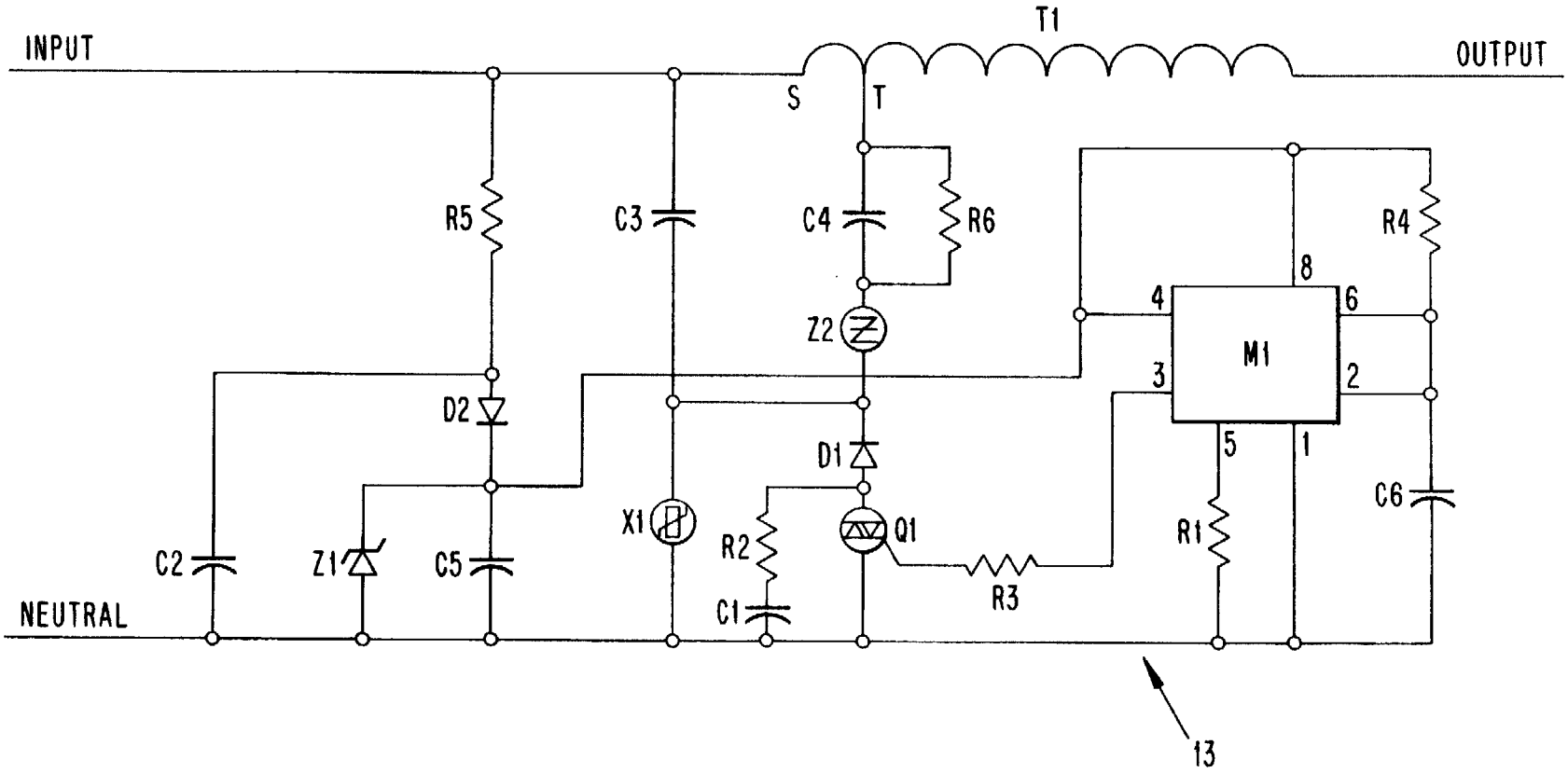
FIG. 2 is a circuit diagram of the integrated rapid restrike and timer cutout circuit.

FIG. 2 illustrates the IRRTC circuit 13 design. The IRRTC circuit 13 can be divided into five functional parts. First, the digital timer circuit M1, has associated with it a time constant, the value of which is determined by resistors R1 and R4 and capacitor C6. Second, the restrike circuit includes an autotransformer T1, capacitors C3 and C4, resistor R6, and SIDAC Z2. Third, the restrike pulse control circuit includes diode D1 and TRIAC Q1. Fourth, protection circuitry for the restrike pulse control circuit includes capacitor C1, resistor R2, and varistor X1. Fifth, the power regulation circuit for the digital timer circuit M1 includes resistor R5, capacitors C2 and C5, diode D2, and zener diode Z1.

In an exemplary embodiment of the present invention, the components of the IRRTC circuit 13 have the following values. However, one skilled in the art will recognize that this list of values is exemplary.

| | | |
|---|---|---|
| C1 | 0.022 μfd | capacitor |
| C2 | 0.022 μfd | capacitor |
| C3 | 2.2 μfd | capacitor |
| C4 | 4.7 μfd | capacitor |
| C5 | 33 μfd | capacitor |
| C6 | 220 μfd | capacitor |
| D1 | 1N4007 | diode |
| D2 | 1N4002 | diode |
| M1 | LM555 | IC timer |
| Q1 | L401E3 | TRIAC |
| R1 | 22 kΩ | resistor |
| R2 | 120 Ω | resistor |
| R3 | 1.0 KΩ | resistor |
| R4 | 5.6 MΩ | resistor |
| R5 | 6200 Ω | resistor |
| R6 | 4000 Ω | resistor |
| T1 | 1:55 (turns ratio) | autotransformer |
| X1 | V430MA3A | metal oxide varistor |
| Z1 | IN961B | zener diode |
| Z2 | K1200E70 | SIDAC |

The operation of the IRRTC circuit 13 will now be described. Initially, the HPS lamp 12 is not illuminated and line voltage 10 causes input power 14 to be applied to the IRRTC circuit 13. In an exemplary embodiment, the line voltage 10 is 120 volts RMS or 170 volts peak-to-neutral. The application of input power 14 to the IRRTC 13, in turn, causes the restrike circuit to begin generating high voltage pulses across the base of lamp 12. The application of input power 14 also causes the digital timer circuit M1 to begin "timing-out" the restrike circuit.

Digital timer circuit M1 contains a voltage comparator with a specific time constant which defines the length of the time-out period. During the time-out period, 10 the IRRTC circuit 13 applies, as mentioned above, high voltage pulses across the base of the HPS lamp 12. When the time-out period elapses, the digital timer circuit M1 prevents the restrike circuit from applying additional pulses until the input line voltage 10 is refreshed (i.e., turned off and turned back on). Since line voltage is not interrupted when, and if, the HPS lamp 12 goes into its cycling phase or when the HPS lamp 12 simply burns out, the IRRTC circuit 13 will not attempt to restart the HPS lamp 12, thereby preventing the HPS lamp 12 from oscillating between an illuminated state and a non-illuminating state.

As stated above, the time-out period is based on the value of the time constant associated with the voltage comparator inside digital timer circuit M1. In turn, the time constant depends upon the specific values of R1, R4, and C6. While the values shown in the table above are exemplary, other values may be used so long as the time-out period provides a sufficient amount of time to restart the HPS lamp 12. Using the exemplary values above, the time-out period will be approximately 5 to 10 minutes. Under normal conditions, 5–10 minutes is more than sufficient to restart the HPS lamp 12.

During the time-out period, the digital timer circuit M1 provides an output signal on pin 3, through R3, to TRIAC Q1. When this output signal is present, Q1 is turned on and the restrike circuit is active. After the time-out period elapses, the digital timer circuit output signal is absent, Q1 is no longer conducting, and the restrike circuit is disabled.

To prolong the life and reliability of TRIAC Q1, it is necessary to employ some means for protecting it against transients and overloads which exceed its ratings. For example, maximum dv/dt and peak voltage when Q1 is off (i.e., not conducting), maximum di/dt when Q1 is being turned on, and peak current when Q1 is fully on (i.e., conducting).

Protection is specifically provided by placing a snubber circuit in parallel with TRIAC Q1. The snubber is comprised of C1 in series with R2. Functionally, C1 limits dv/dt to prevent unintentional firing while R2 prevents excessive di/dt when Q1 is conducting. Also, C1 absorbs energy from voltage spikes. In general, snubbers are well known in the art. In addition to the snubber circuit, metal oxide varistor X1 provides additional protection for Q1.

The regulation of power to the digital timer circuit M1 will now be described in greater detail. As mentioned above, the power regulation circuitry for digital timer circuit M1 includes R5, D2, Z1, C5 and C2 (see FIG. 2). More specifically, R5 in combination with D2 serves as a simple half-wave rectifier that provides voltage to pin 4 and pin 8 of digital timer circuit M1 during the positive half of the input voltage sine wave. During the negative half of the input voltage sine wave, C5 (which charges during the positive half of the input voltage sine wave) discharges, thus maintaining the voltage across pins 4 and 8. Although the input voltage is 120 volts RMS, Z1 acts as a voltage regulator, limiting the voltage across pin 4 and pin 8 to 10 volts. In addition, C2 filters out unwanted pulses. Therefore, digital timer circuit M1 continuously receives a 10 volt input signal so long as there is no interruption in line voltage 10. As long as digital timer circuit M1 continues to receive this 10 volt supply, it will not reset itself, and it will continue to prevent the restrike circuit from generating pulses across the base of HPS lamp 12 after the time-out period elapses.

Figure 3:
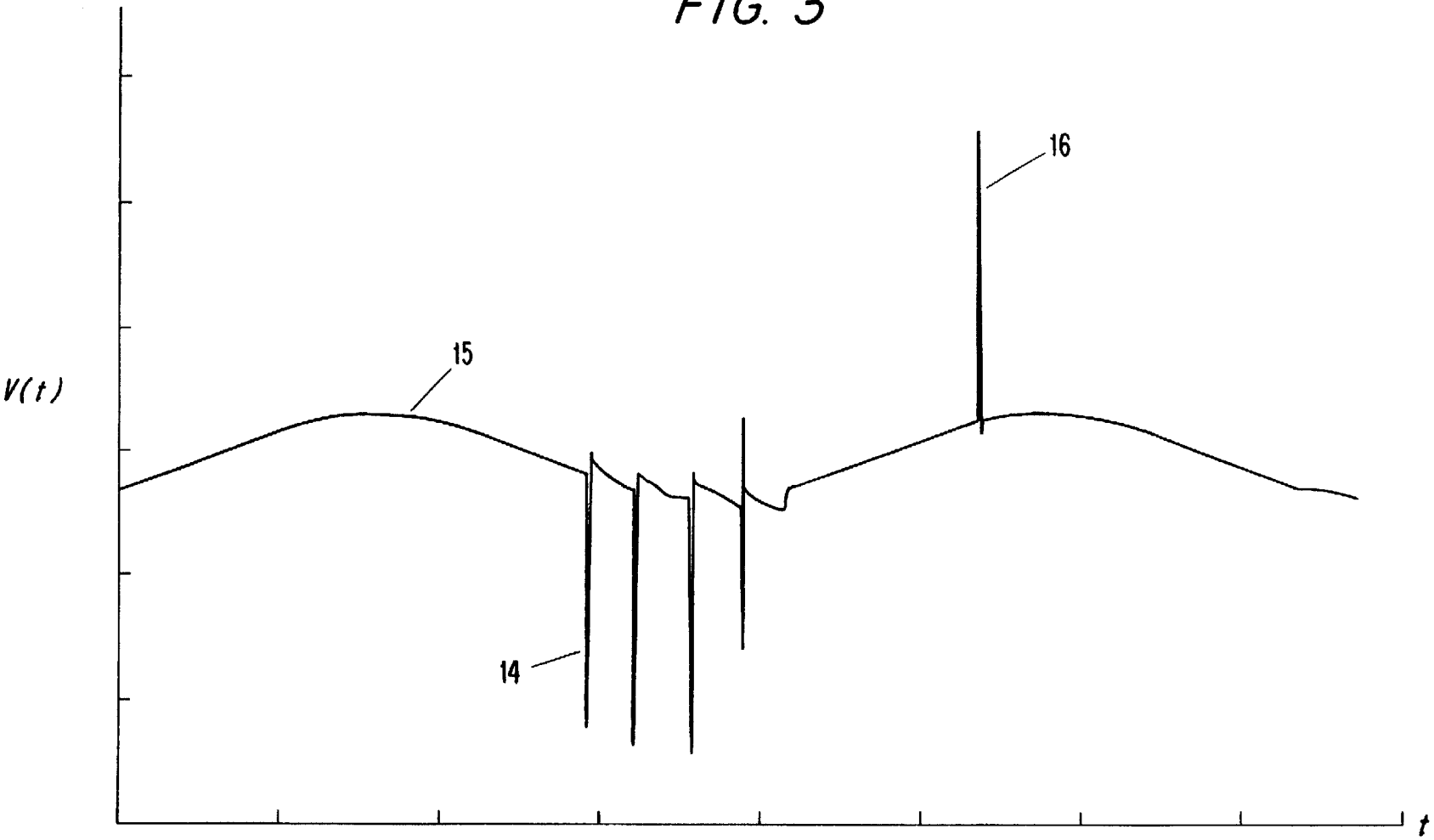
FIG. 3 illustrates an input voltage sine wave and the high voltage pulses generated by the integrated rapid restrike and timer cutout circuit.

The restrike circuit and the generation of high frequency, high voltage pulses will now be described in greater detail. The IRRTC circuit 13 stores the energy it needs, in capacitors C3 and C4, to produce high voltage pulses across the base of lamp 13 (i.e., output 15). Capacitors C3 and C4 and the inductance associated with T1 form a resonant circuit, where T1 actually produces a burst of high voltage pulses 14 (i.e., ringing effect), as illustrated in FIG. 3, when the energy stored in the capacitors discharges.

Of course, C3 and C4 will only discharge when SIDAC Z2 is conducting. SIDAC Z2 begins conducting as soon as the voltage across its terminals exceeds a specific threshold value. In the exemplary embodiment, this threshold is approximately 120 volts. SIDAC Z2 will continue to conduct until the current through the device drops below a specific level. In the exemplary embodiment, this will occur when the current is approximately 60 milliamps or less.

As stated above, the high voltage pulses must have sufficient energy to ionize the gas contained inside the HPS lamp 12 in order for the lamp 12 to conduct (i.e., illuminate). In order for the pulses to contain sufficient energy, the IRRTC circuit 13 must generate them at or near the peak of the input voltage sine wave 15 (i.e., between 65° and 110° or between 245° and 290°), as illustrated in FIG. 3. The IRRTC circuit 13 controls this as follows. During the negative half of the sine wave 15, voltage again builds to 120 volts at about 225° (or 45° past the zero voltage crossing). At this point, Z2 begins conducting. The exact time the pulses 14 occur depends highly on the charge on C3 when Z2 begins conducting and the time it takes C4 to charge through R6 after Z2 begins conducting. However, as shown in FIG. 3, the burst of pulses 14 is generated at about 225° on the input voltage sine wave. In prior designs, high watt resistors are used instead of D1 and Q1 to control the timing of the high voltage pulses. With high watt resistors, the pulses are typically generated at the peak of the sine wave (i.e., 90°). However, as explained above, high watt resistors generate an excessive amount of heat and the use of such resistors would preclude one from effectively combining the restrike and digital timer cutout devices into a single, integrated circuit. Therefore, the present invention employs D1 and Q1, which generate far less heat, in place of high watt resistors.

During the positive half of the input voltage sine wave 15, voltage again builds but conduction through Q1 will be blocked by D1. Therefore, IRRTC circuit 13 does not produce a burst of pulses during the positive half of the sine wave. Although a single pulse 16 during the positive half of the sine wave is possible (see FIG. 3), the overall effect is to reduce the total number of pulses across the base of HPS lamp 12. Therefore, D1 and Q1 again help to minimize ambient lamp temperature caused by excessive pulsing.

Once when the time-out period expires, the digital timer circuit M1 prevents Q1 from conducting. As a result, the restrike circuit becomes disabled, capacitors C3 and C4 no longer charge and discharge through T1, and T1 no longer produces high voltage pulses across the base of lamp 12.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An electronic circuit for illuminating a HID lamp, including a hot HID lamp, wherein a hot HID lamp has a temperature that is at or substantially equal to an operating temperature of an illuminated HID lamp, said circuit comprising:

a restrike ignitor circuit that generates a plurality of restrike pulses for illuminating a hot HID lamp, and a digital timer cutout that prevents said restrike ignitor circuit from generating said plurality of restrike pulses after a time-out period elapses, wherein said restrike ignitor circuit and said digital timer cutout are combined into a single, integral circuit.

2. The electronic circuit of claim 1 further comprising:

a pulse control circuit that restricts said restrike ignitor circuit to generating said plurality of restrike pulses during a predetermined interval of an input voltage waveform, such that heat generated by said restrike ignitor circuit is minimized.

3. The electronic circuit of claim 2, wherein said interval corresponds to the negative half-cycle of the input voltage sine wave.

4. The electronic circuit of claim 2, wherein said pulse control circuit comprises a TRIAC connected to said restrike ignitor circuit by a diode.

5. An electronic circuit for controlling the generation of a plurality of restrike pulses for a HID lamp comprising:

a restrike ignitor circuit that generates said plurality of restrike pulses;

a digital timer cutout that prevents said restrike ignitor circuit from generating said plurality of restrike pulses after a time-out period elapses; and a pulse control circuit that causes said restrike ignitor circuit to generate said plurality of restrike pulses during a predetermined interval of an input voltage waveform in order to minimize heat generation, wherein said restrike ignitor circuit, said digital timer cutout, and said pulse control circuit are combined into a single, integral circuit.

6. The circuit of claim 5, wherein said restrike ignitor circuit comprises:

a first and a second storage capacitor for storing energy to generate said plurality of restrike pulses;

a resistor in parallel with said second storage capacitor for charging said second storage capacitor;

an autotransformer having an inherent inductance which forms a resonant circuit with said first and said second storage capacitors, such that said resonant circuit generates said plurality of restrike pulses; and a SIDAC which triggers said resonant circuit to generate said plurality of restrike pulses only when an input voltage level reaches a predefined voltage level.

7. The electronic circuit of claim 5, wherein said pulse control circuit comprises a TRIAC directly connected to said restrike ignitor circuit by a diode.

8. The electronic circuit of claim 7, wherein said predetermined interval corresponds to a negative half-cycle of the input voltage waveform.

9. An apparatus for controlling HID lamp illumination, including the illumination of a hot HID lamp, wherein a hot HID lamp has a temperature that is at or substantially equal to an operating temperature of an illuminated HID lamp, said apparatus comprising:

means for generating a plurality of restrike pulses for illuminating a hot HID lamp; and means for preventing said restrike pulses after a time-out period elapses, wherein said means for generating said plurality of restrike pulses and said means for preventing said restrike pulses are combined into a single, integral circuit.

10. The apparatus of claim 9 further comprising:

means for controlling the generation of said restrike pulses such that said means for generating said plurality of restrike pulses generates said plurality of restrike pulses during a predetermined interval of an input voltage sine wave, thus minimizing heat generation.

11. The apparatus of claim 10, wherein said predetermined interval corresponds to a negative half-cycle of the input voltage sine wave.

12. The electronic circuit of claim 10, wherein said means for controlling the generation of said restrike pulses comprises a TRIAC connected to said means for generating the plurality of restrike pulses by a diode.

13. An apparatus for controlling HID lamp illumination comprising:

means for generating said plurality of restrike pulses for illuminating said HID lamp;

means for preventing said plurality of restrike pulses after a time-out period elapses; and means for controlling the timing of said restrike pulses such that said means for generating said plurality of restrike pulses generates said plurality of restrike pulses during a predetermined interval of an input voltage sine wave, thus minimizing heat generation, wherein said means for generating said plurality of restrike pulses, said means for preventing said plurality of restrike pulses, and said means for controlling the timing of said plurality of restrike pulses are combined into a single, integral circuit.

14. The circuit of claim 13, wherein said means for generating said plurality of restrike pulses comprises:

first and second energy storage means for storing energy to generate said plurality of restrike pulses;

inductive means forming a resonant circuit with said first and said second storage means, such that said resonant circuit generates said plurality of restrike pulses; and switching means for triggering said resonant circuit to generate said plurality of restrike pulses when an input voltage level reaches a predefined voltage level.

15. The apparatus of claim 13, wherein said means for controlling the timing of said plurality of restrike pulses comprises a diode in series with a TRIAC, and wherein said diode directly connects said TRIAC to said means for generating said plurality of restrike pulses.

16. The electronic circuit of claim 15, wherein said predetermined interval corresponds to a negative half-cycle of the input voltage sine wave.

* * * * *